US011484137B1

(12) United States Patent
Nottingham

(10) Patent No.: US 11,484,137 B1
(45) Date of Patent: Nov. 1, 2022

(54) PAPER STRAW

(71) Applicant: Lynn M. Nottingham, San Diego, CA (US)

(72) Inventor: Lynn M. Nottingham, San Diego, CA (US)

( * ) Notice: Subject to any disclaimer, the term of this patent is extended or adjusted under 35 U.S.C. 154(b) by 454 days.

(21) Appl. No.: 16/598,083

(22) Filed: Oct. 10, 2019

(51) Int. Cl.
*A47G 21/18* (2006.01)
*B26F 3/00* (2006.01)

(52) U.S. Cl.
CPC ..... *A47G 21/18* (2013.01); *B26F 3/002* (2013.01); *A47G 2400/10* (2013.01)

(58) Field of Classification Search
CPC ..... A47G 21/18–189; A47G 2400/10
See application file for complete search history.

(56) References Cited

U.S. PATENT DOCUMENTS 5,718,681 A * 2/1998 Manning ..... A47G 21/183 239/33
10,011,413 B1 7/2018 Ryan
2014/0166680 A1* 6/2014 St. Gelais ..... A47G 21/183 220/710

* cited by examiner

*Primary Examiner* — Tuongminh N Pham
(74) *Attorney, Agent, or Firm* — Sanchelima & Associates, P.A.; Christian Sanchelima; Jesus Sanchelima

(57) ABSTRACT

A paper straw including a straw assembly, a shortening assembly, a drinking assembly is disclosed. The paper straw includes a cylindrical biodegradable body comprising multiple perforation lines along the top portion of the straw wherein damaged sections of the straw can be removed by ripping or tearing the section off. This allows for using of a same straw even when the top portion is damaged or soggy. This aids in environmental friendliness, as less paper straws have to be used. When it comes time to dispose of the paper straw minimal damage is done to the environment as the paper straw is biodegradable.

6 Claims, 2 Drawing Sheets

PAPER STRAW

II. BACKGROUND OF THE INVENTION

1. Field of the Invention

The present invention relates to a paper straw and, more particularly, to a paper straw that can be shortened for continued drinking as the top portion of the straw is damaged.

2. Description of the Related Art

Several designs for paper straws have been designed in the past. None of them, however, include a cylindrical biodegradable paper drinking straw comprising multiple perforation lines along the top portion of the straw wherein damaged sections of the straw can be removed by ripping or tearing the section off.

Applicant believes that a related reference corresponds to U.S. Patent No. 2012/0181348 issued for a beverage straw comprising a replaceable mouthpiece. Another related reference corresponds U.S. Pat. No. 10,011,413 for a drinking straw having a removable cover. None of these references, however, teach of a biodegradable paper drinking straw that be shortened for ease of continued drinking when a top portion of the straw is damaged.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a straw having a top portion that can be partially removed at perforation lines for ease of continued drinking through the straw even as the top portion gets damaged.

It is another object of this invention to provide a straw that is disposable and biodegradable.

It is still another object of the present invention to provide a perforated straw that can be shortened to accommodate usage in drinkware of different dimensions.

It is yet another object of this invention to provide such a straw that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
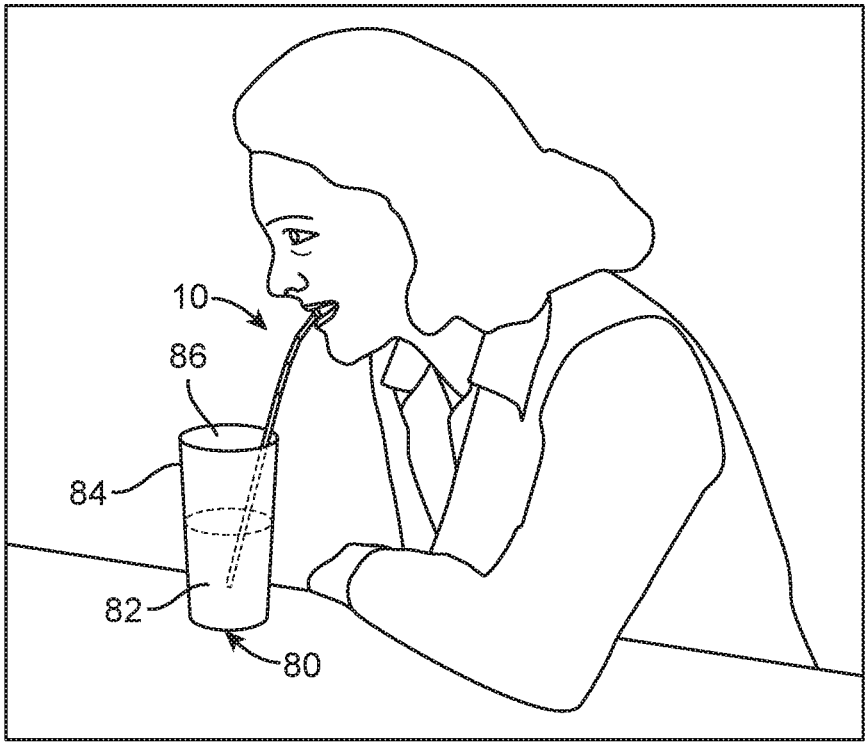
FIG. 1 represents the present invention in an operational setting.

Referring now to the drawings, where the present invention is generally referred to with numeral 10, it, paper straw 10, can be observed that it basically includes a straw assembly 20, a shortening assembly 40, a drinking assembly 80.

Figure 2:
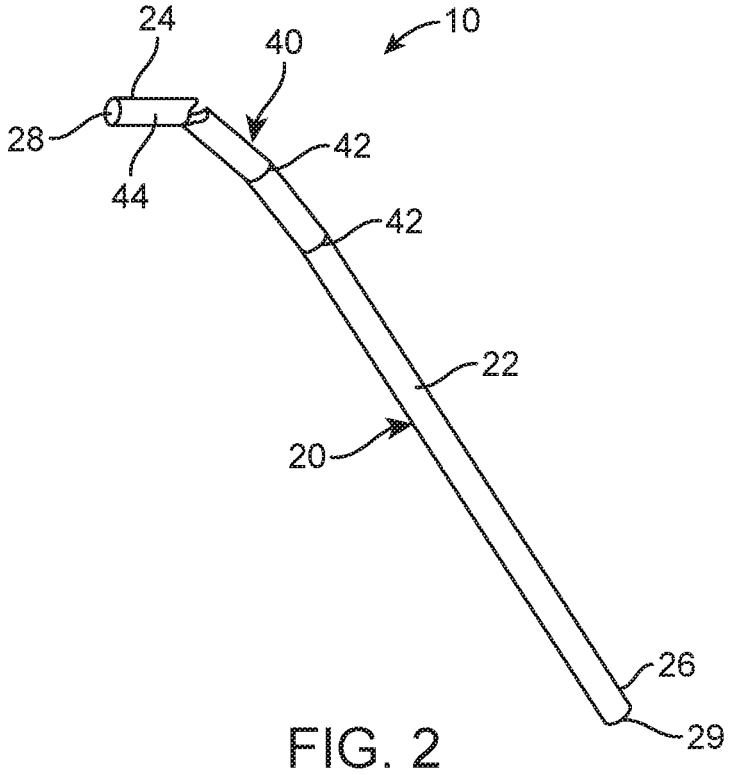
FIG. 2 shows the present invention being shortened along perforations lines located on a top portion thereof.
Figure 3:
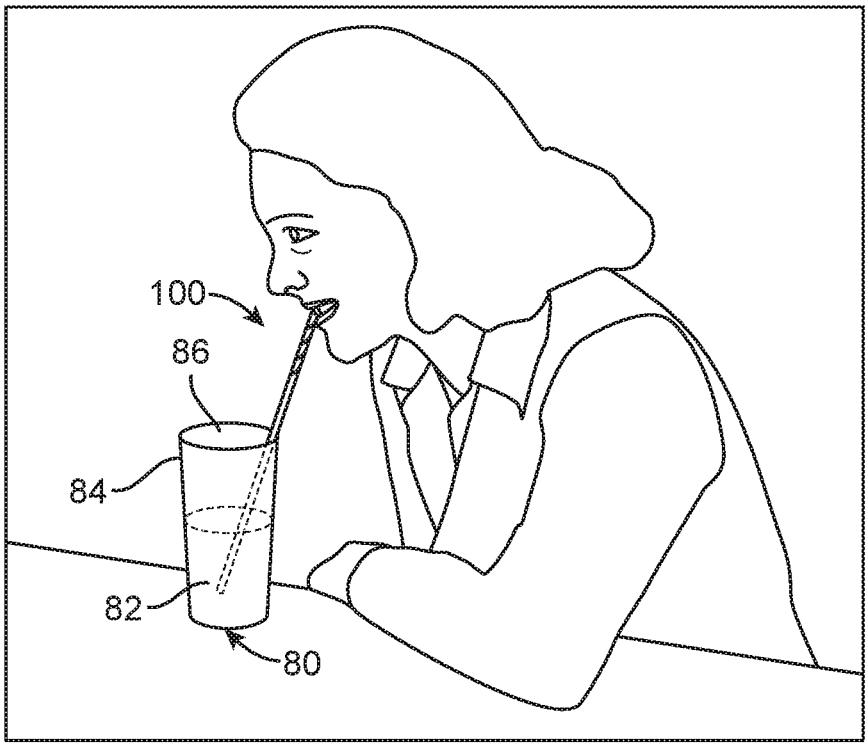
FIG. 3 illustrates an alternate embodiment of the present invention.
Figure 4:
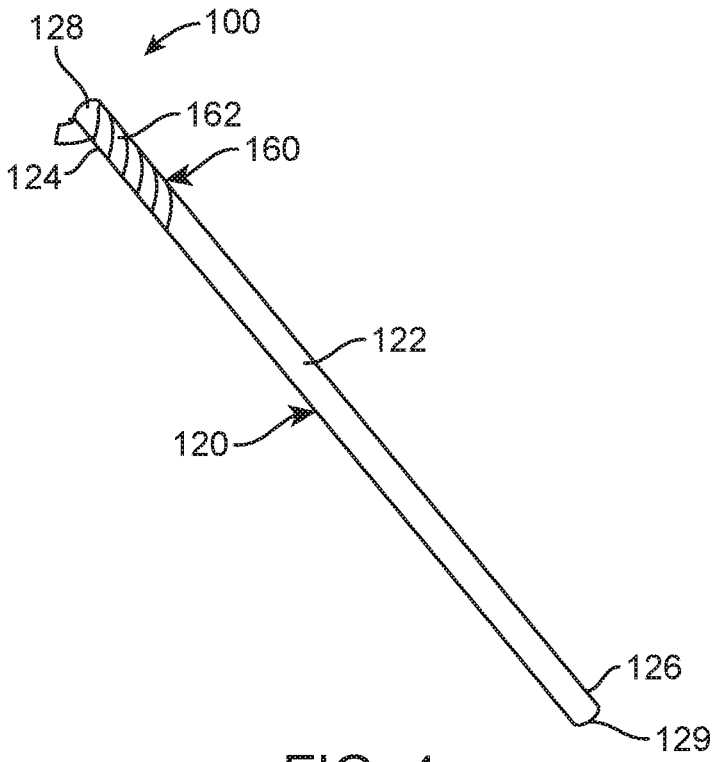
FIG. 4 is a representation of the alternate embodiment of the present invention being shortened for removal of damaged portions.

Referring to FIGS. 1-4, the present invention, paper straw 10 can be seen. In one embodiment, paper straw 10 may preferably be made of paper. However, it should be understood that other materials such as cardboard, plastic, rye grass or any other suitable material may be used for paper straw 10. It is preferred that paper straw 10 be made of bio-based, renewable, biodegradable, recyclable, and/or composable material. It should be understood paper straw 10 may preferably be one time use and disposable.

Paper straw 10 includes a straw assembly 20 including a straw body 22. In one embodiment, straw body 22 may be cylindrical and elongated. It may be preferable that straw body 22 be biodegradable as to be less harming to the environment. Straw body 22 may include a top portion 24 and a bottom portion 26. It should be understood that straw body 22 may be of predetermined dimensions. Top portion 24 may be where a user U may place their lips thereon in order to drink a beverage B in which paper straw 10 is inserted into. Straw assembly 20 of the present invention further includes a top opening 28 and a bottom opening 29. Top opening 28 may be nearest to top portion 24 at a distalmost end of straw body 22. Bottom opening may be nearest to bottom portion 29 at a distal end of straw body 22. Straw body 22 may be hollow on an interior to allow beverage B to flow freely from bottom opening 29 to top opening 28. The user places their lips on top portion 24 and sucks through top opening 28 in order to allow for a liquid or beverage B near bottom opening 29 to be moved through straw body 22 and into the mouth of user U.

The present invention may include a drinking assembly 80. Drinking assembly 80 may include a drinkware 82 having a drinkware body 84 of a predetermined dimension. Drinkware body 84 may be made of plastic, metal, aluminum, rubber or any other suitable material. Drinkware body 84 may include a drinkware opening 86 on a top side thereof. Drinkware body 84 may have a closed bottom side to permit holding liquids therein. Paper straw 10 may be inserted into drinkware body 86, having beverage B therein, through drinkware opening 86 to allow drinking of beverage B with paper straw 10 as described previously.

Paper straw 10 may be used to drink beverages and as paper straw 10 is preferably made of paper, paper straw 10 may get damaged or soggy due to being in direct contact with beverage B and the mouth of user U. Typical paper straws are rendered useless or annoying at this point. As such paper straw 10 includes shortening assembly 40 on top portion 24. Shortening assembly 40 may include perforation lines 42 at predetermined locations on top portion 24. In the immediate embodiment, three of perforation lines 42 are depicted, but it should be understood that any predetermined number of perforation lines 42 may be suitable. Shortening assembly 40 may further include breakable portions 44. The number of breakable portions 44 corresponds with the number of perforation lines 42. In one embodiment, breakable portions 44 may extend up to a half of said straw body 22 of paper straw 10. In an alternate embodiment, breakable portions 44 may extend the entire length of straw body 22. In another embodiment, breakable portions 44 and perforation lines 42 may extend only along top portion 24 and bottom portion 26. Thereby allowing a user to removed portions that have become damaged at either top portion 24 by the mouth of user U or at bottom portion 26 from sitting in beverage B too long. Each of breakable portions 44 includes one of perforation lines 42 directly below thereof. Each of perforation lines 42 may extend entirely around the circumference of paper straw 10 at predetermined locations on top portion 24. Perforation lines 42 may preferably extend horizontally and be parallel to one another. Perforation lines 42 may have small enough perforations that beverage B does not seep through. As user U drinks beverage from drinkware 82 with paper straw 10, top portion 24 will become partially damaged. Once the damage has been done to the current one of breakable portions 44 then it is removed by tearing or ripping along the topmost of perforation lines 42. Thereby resulting in a new top portion 24 that is readily usable for drinking of beverage B without any annoyance of a damaged or soggy straw. It should be understood that, straw body 22 may preferably have a length greater than said drinkware 82 even upon removal of all of breakable portions 44. This can be done until all of perforation lines 42 have be torn or ripped to remove breakable portions 44 which were damaged portions. Once all breakable portions 44 which are damaged have been removed and top portion 24 becomes damaged yet again then a new of paper straw 10 may be used. Paper straw may be disposable and biodegradables as to minimize damage done to the environment through disposal thereof. Perforation lines 42 may as well be used to shorten paper straw 10 to a comfortable length in order to be able to use paper straw 10 with drinkware 82 of different dimensions and lengths. Paper straw 10 may typically be longer than any cup or drinkware 82 and shortened to a length that allows for easy and comfortable drinking of beverage B from drinkware 82 regardless of dimensions of drinkware 82. With the present invention there may be a reduction in waste as there may be a same present invention used with any of drinkware 82 instead of requiring straws of multiple sizes to be used to accommodate different sized cups and the like. Further, this puts retailers, restaurants, and the like at ease as they have less worries about whether they have enough straws of a particular size, for example, tall and short straws, instead stock of just one straw such as paper straw 10 is all that needs to be monitored and maintained.

In an alternate embodiment, a spiral assembly 160 may be included instead of shortening assembly 40. Paper straw 100 may be similar in structure as the aforementioned embodiment except that spiral assembly 40 may be located at a top portion 124 instead of shortening assembly 40. Paper straw 100 may include a straw body 122 having top portion 124 with a top opening 128 and also a bottom portion 124 having a bottom opening 129. Paper straw 100 may be used with drinking assembly 80. Once top portion 124 becomes damaged or soggy spiral assembly 160 may be used to remove the damaged portion thereof. Spiral assembly 160 may include an unraveling portion 162 extending along straw body 122 diagonally along the circumference of straw body 122. In one embodiment, unraveling portion 160 may extend up to a half of straw body 122. In an alternate embodiment, unraveling portion 160 may extend the entire length of straw body 122. Unraveling portion may extend a predetermined length of straw body 122 near top portion 122. Once top portion 124 is damaged, unraveling portion 162 is unraveled until the damaged portion is entirely unraveled. After all of the damaged portion of unraveling portion is identified, user U may simply rip or removed that damaged portions. Thereby resulting in a new top portion 124 that is not damage for easy and comfortable continued drinking of beverage B with paper straw 100 from drinkware 82.

The user may use the present invention in order to drink from a cup with a straw made of paper as to be environmentally friendly. After continued drinking from the cup with the present invention, portions of the paper straw will get soggy or damaged. The present invention allows for removal of those damaged and soggy portions, easily, to allow the user to continue using the same paper straw thereby reducing waste. It should be understood that the removal of the damaged portions is preferably done with merely the hands of a person operating the present invention, no additional equipment is to be required.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a paper straw, comprising:

a. said paper straw, said straw being cylindrical and having a top portion and a bottom portion, said straw being hollow therebetween a top opening and a bottom opening thereof said straw, said top opening may be at a distalmost end of said straw and said bottom opening may be at a distal end of said straw;

b. a shortening assembly including at least three perforation lines and at least three breakable portions, shortening assembly may be mounted at said top portion, said at least three perforation lines are extended around the circumference of said straw at predetermined locations on the top portion, said at least three perforation lines extend horizontally along said top portion, each of said at least three perforation lines have perforations, said perforations are small enough to prevent beverage to seep through, said perforations extend along each of said at least three perforation lines, said at least three perforation lines create said at least three breakable portions that may be removed or torn by tearing away at the perforation lines below said breakable portions, wherein said at least three breakable portions are located one above the other defining a curvature with respect to a central portion of said straw, wherein each of said at least three breakable portions are adapted to be manually removed once they become damaged portions due to constant usage leading to sogginess, wherein an exterior surface of each of said at least three breakable portions is plain, wherein said curvature is modular by removing at least one of said at least three breakable portions, wherein a length of said straw is modular by removing at least one of said at least three breakable portions; and c. a drinking assembly including a drinkware having a body and a drinkware opening atop, said drinkware may hold a beverage therein said body, said paper straw allows said beverage to be transferred from said drinkware to the mouth of a user.

2. The system of claim 1, wherein said paper for said straw is bio-based, renewable, biodegradable, recyclable, or composable.

3. The system of claim 1, wherein said paper straw is disposable.

4. The system of claim 1, wherein said straw has a length greater than said drinkware even after removal of all said at least three breakable portions.

5. The system of claim 1, wherein said at least three breakable portions extend up to a half of said straw body.

6. A system for a paper straw, consisting of:

a. said paper straw, said straw being cylindrical and having a top portion and a bottom portion, said straw being hollow therebetween a top opening and a bottom opening thereof said straw, said top opening may be at a distalmost end of said straw and said bottom opening may be at a distal end of said straw, wherein said paper for said straw is bio-based, and composable, said straw is disposable;

b. a shortening assembly including three perforation lines and three breakable portions, shortening assembly may be mounted at said top portion, said three perforation lines are extended around the circumference of said straw at predetermined locations on the top portion, said three perforation lines extend horizontally along said top portion, each of said three perforation lines have perforations, said perforations are small enough to prevent beverage to seep through, said perforations extend along each of said three perforation lines, said three perforation lines create said three breakable portions that may be removed or torn by tearing away at the perforation lines below said breakable portions, wherein said three breakable portions are located one above the other defining a curvature with respect to a central portion of said straw, wherein each of said three breakable portions are adapted to be manually removed once they become damaged portions due to constant usage leading to sogginess, wherein an exterior surface of each of said three breakable portions is plain, wherein said curvature is modular by removing at least one of said three breakable portions, wherein a length of said straw is modular by removing at least one of said at least three breakable portions said three breakable portions extend up to a half of said straw body; and c. a drinking assembly including a drinkware having a body and a drinkware opening atop, said drinkware may hold a beverage therein said body, said paper straw allows said beverage to be transfer from said drinkware to the mouth of a user, wherein said straw has a length greater than said drinkware even after removal of all said three breakable portions.

* * * * *